United States Patent [19]

Stoll

[11] Patent Number: 4,607,509

[45] Date of Patent: Aug. 26, 1986

[54] COUNTERFLOW CYCLING WASHING MACHINE

[75] Inventor: Karl-Heinz Stoll, Wiesbaden, Fed. Rep. of Germany

[73] Assignee: Senkingwerk GmbH, Hildesheim, Fed. Rep. of Germany

[21] Appl. No.: 672,582

[22] Filed: Nov. 16, 1984

[30] Foreign Application Priority Data

Nov. 17, 1983 [DE] Fed. Rep. of Germany ..... 3341504

[51] Int. Cl.[4] ..... D06F 31/00

[52] U.S. Cl. ..... 68/27

[58] Field of Search ..... 68/27, 58

[56] References Cited

U.S. PATENT DOCUMENTS 4,485,509 12/1984 Pellerin et al. ..... 68/27 X

FOREIGN PATENT DOCUMENTS 2949228 6/1981 Fed. Rep. of Germany .

203345 10/1983 German Democratic Rep. .... 68/27

2066302 7/1981 United Kingdom ..... 68/27

*Primary Examiner*—Philip R. Coe

*Attorney, Agent, or Firm*—Karl F. Ross; Herbert Dubno

[57] ABSTRACT

When both colored and white wash are to be laundered together, one has the problem that pigment particles are transported from the colored pieces to the white pieces and the white pieces are discolored. This problem will be eliminated in a novel counterflow cycling washing machine by providing additional components besides the control components for the counterflow which produce a reversal of the usual counterflow to concurrent flow when a colored piece of wash is in the machine or the washing zone. For the case of concurrent flow operation the counterflow pump is shut off and the counterflow discharge outlet valve and the counterflow input tube valve are closed, while the valve in the concurrent flow discharge outlet positioned near the counterflow input tube and the valve in the concurrent flow input tube positioned near the counterflow discharge outlet are opened.

1 Claim, 2 Drawing Figures

COUNTERFLOW CYCLING WASHING MACHINE

FIELD OF THE INVENTION

This invention relates to a counterflow cycling washing machine having a plurality of washing zones each of which has a plurality of washing compartments.

BACKGROUND OF THE INVENTION

A continuous washing path has been employed for laundering large quantities of items. Generally these items are passed through the washing machine in a direction opposite to the flow of washing or rinsing liquid and especially in the washing process to facilitate economical water and energy consumption.

The elongated washing trommel or drum is rotated about its longitudinal axis and is subdivided axially into a number of washing chambers or compartments and into a plurality of washing zones each formed by a plurality of adjacent washing chambers.

For example a single counterflow cycling washing machine drum of this type often may be divided into an initial soaking zone having two or more compartments, a true washing zone having the largest number of compartments, and a rinsing zone which can have fewer compartments than the washing zone.

The items to be washed are fed to a loading washing chamber and thereafter are transferred in discrete batches from one chamber to another through the individual washing chambers and zones according to a cyclic process. Specifically, the drum may angularly oscillate about its axis to a certain extent to agitate each batch in the respective chamber in a corresponding treatment liquid and in accordance with the desired washing cycle. Then a further rotation of the drum will automatically transfer the batches in a direction of movement into the next compartment (see Re. Pat. No. 30,214 and U.S. Pat. No. 4,020,659).

Toward the end of the wash trommel which is downstream with respect to the movement of wash, fresh water is supplied which at least partialy flows through the washing trommel in counterflow to the laundered articles. These processes are problem free as long as only white pieces of wash are washed in such a unit.

The proportion of pigmented wash, for example green or blue wash, colored bedding, table cloths or napkins is currently very large and is expected to grow further. However when brightly colored and white wash materials are laundered together in a cyclic washing unit, then colored particles flow from the pigmented fabrics to the white fabrics and discolor them.

To avoid such discoloration of the white wash, the colored materials have hitherto been washed either in a separate machine or in a bath-change washing stretch which does not work by counterflow. This means higher investment costs, since the bath-change washing stretch is considerably more expensive than a counterflow washing machine and it means higher wash costs. The use of this unit costs considerably more than does that of the counterflow washing machine.

If on account of these disadvantages one nevertheless directly washes the colored laundry in a counterflow wash channel, then the bulk of the wash chambers must be left empty so that the staining of a subsequent white wash will be prevented. With strongly colored materials 60–70% of the washing machine should be left empty. Because of that the performance of the machine is considerably reduced, although on the other hand the machine usage cannot be reduced economically because water, steam and washing liquors must be supplied in the same amounts even when there is no wash in some of the chambers.

In order to eliminate these empty chambers and the difficulties involved in their use, as taught by German Patent DE-OS No. 29 49 228, the liquid counterflow can be bypassed around the wash chamber in which one finds a colored batch of wash by a plurality of valves and shunt pipes. This also in principle maintains the counterflow except for the selected wash chamber filled with colored wash. However an expensive and cumbersome control apparatus is required for this system.

OBJECTS OF THE INVENTION

The basic object of this invention is to provide an improved continuous or flow-through washing machine which is able to wash both colored and white laundry together simultaneously without the need to leave empty washing chambers between them.

It is also an object of this invention to provide an improved counterflow cycling washing machine which will wash colored and white wash together without employing empty chambers or load spacing more economically and easily than prior art counterflow cycling washing machines.

SUMMARY OF THE INVENTION

These objects and others which will become apparent hereinafter are attained in accordance with the invention in a method of operating a counterflow cyclic washing machine as described wherein, upon entry of colored laundry into the washing zone and during the presence of the colored laundry in this zone, the counterflow pumps which displace the washing liquid from chamber to chamber are cut off and the washing liquid is switched to feed from an inlet at an upstream compartment of the zone occupied by the colored laundry and to discharge from a downstream compartment of that zone.

The above-mentioned problems of the prior art washing machines are thus solved by reversing the washing machine or individual washing zones from counterflow to concurrent flow (i.e. bath flow is reversed so that it is opposite to that of counterflow and in the direction of movement of laundered articles) as long as a piece of pigmented wash is found in the machine or washing zone.

The bath flow reversal is accomplished by an additional flow control means for any or all the washing zones of a counterflow cycling washing machine.

These additional flow control means comprise an outlet valve for the counter flow discharge outlet, if it has not been provided in the usual machine design, and an additional wash fluid input pipe and input valve near the discharge outlet for counterflow liquid and an additional wash fluid discharge outlet and discharge valve near the inlet for the wash fluid during counterflow.

Concurrent flow is achieved by passing wash fluid, preferably fresh water, through the additional input tube and withdrawing wash fluid from the discharge outlet for concurrent flow, while the couterflow pumps are shut off by a pump control means provided therefor and the input valve and the outlet valve for counterflow are closed.

One has in this way the advantages of a counterflow cycling washing machine combined with a kind of multi liquor washing machine which works more by a steeping or soaking process so that without further change the machine can be operated as one or the other.

BRIEF DESCRIPTION OF THE DRAWING

The novel features and advantages of this invention will now be made more apparent from the following detailed description with reference to the accompanying drawing in which.

SPECIFIC DESCRIPTION

Figure 1:
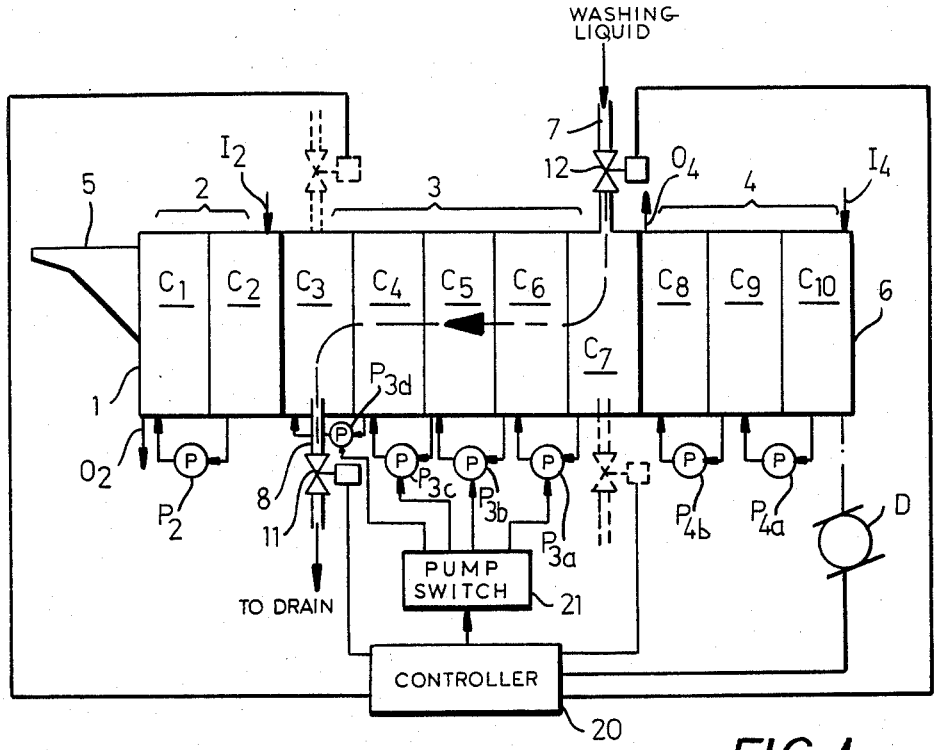
FIG. 1 is a flow diagram of a washing machine in accordance with this invention showing the control components and piping functioning during counterflow operation.

A washing trommel 1 divided into individual chambers ($C_1$–$C_{10}$) grouped into a soaking/prewashing zone 2 ($C_1$,$C_2$), a main washing zone 3 ($C_3$–$C_7$), and a rinsing zone 4 ($C_8$–$C_{10}$), is rototable about its longitudinal axis by a drive D, whereby the wash is advanced through the machine in a known way from the upstream entrance 5 compartment by compartment and is fed into a water extraction press after discharge from its downstream end 6. In each compartment the laundry is agitated for a predetermined period set by the controller 20 before the laundry is transferred to the next compartment.

Customarily the wash fluid will be fed in counterflow to the transport of the wash materials, that is in the direction opposite to the direction of flow of the pieces to be washed as shown in FIG. 1 for the pure washing zone 3. The wash fluid is fed into the downstream end of the pure washing zone 3 through input pipe 7 having an electromagnetic input valve 12 and drained from a discharge outlet 8 having an electromagnetic outlet valve 11 at the upstream end of the pure wash zone 3, where "downstream" and "upstream" refers to the direction of transport of the wash.

Figure 2:
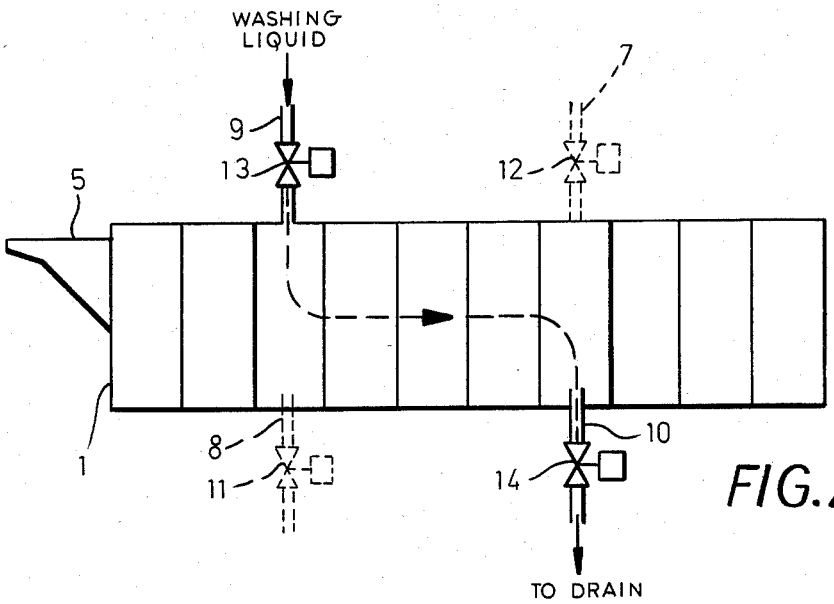
FIG. 2 is a diagram of the machine of FIG. 1 during concurrent flow operation.

So that the wash fluid can as needed be also fed concurrent with the flow of wash, additional wash fluid input pipe 9 and electromagnetic input valve 13 are provided at the upstream end of the main washing zone 3 and an additional discharge outlet 10 and outlet electromagnetic valve 14 are provided at the downstream end of the main wash zone 3 so that during concurrent flow the wash fluid flow is as shown according to the arrows in FIG. 2. Therefore to provide concurrent flow instead of counterflow discharge outlet valve 11 and input valve 12 are closed as input valve 13 and discharge output valve 14 are opened and the wash fluid pump is shut off.

The invention has been described as applied to the pure washing zone 3 in the above embodiment but is also applicable to the other washing zones or to the entire machine.

The controller 20, therefore, in addition to timing the operation of the counterflow pumps $P_{4a}$,$P_{4b}$ of the rinsing zone 4 and the pump $P_2$ of the soaking/prewash zone 2 can operate a switch 21 for cutting off the counterflow pumps $P_{3a}$–$P_{3d}$ between the compartments, $C_7$, $C_6$, $C_5$, $C_4$ and $C_3$ of the washing zone simultaneously with closure of valves 11 and 12 and opening of valves 13 and 14. The transfer of liquid from compartment to compartment in the washing zone is here effected by the drum with transfer of the laundry.

I claim:

1. A counterflow cycling washing machine, comprising:

a washing trommel axially divided into a plurality of washing zones, each divided into a plurality of washing chambers traversed in one direction by batches of wash in succession;

respective wash fluid pumps connecting a downstream one of said chambers to an upstream one of said chambers with respect to said direction for each of said zones for effecting counterflow of wash liquid in a direction opposite said one direction;

an inlet communicating with an upstream end of one of said zones with respect to said one direction;

a first outlet communicating with a downstream end of said one of said zones with respect to said one direction;

a second outlet communicating with said upstream end of said one of said zones;

respective valves connected to said inlet and to said outlets so that said second outlet is effective during counterflow and the valves of said inlet and said first outlet are open during a concurrent flow of said fluid in said one direction; and pump control means for switching off said counterflow pumps of said one of said zones when concurrent flow begins.

* * * * *